US007607320B2

(12) United States Patent
Perle

(10) Patent No.: US 7,607,320 B2
(45) Date of Patent: Oct. 27, 2009

(54) INTERLOCKING JEWELRY LINKS

(76) Inventor: Amit Perle, 2031 Ocean Ave., #B1, Brooklyn, NY (US) 11230

( * ) Notice: Subject to any disclaimer, the term of this patent is extended or adjusted under 35 U.S.C. 154(b) by 76 days.

(21) Appl. No.: 11/765,213

(22) Filed: Jun. 19, 2007

(65) Prior Publication Data

US 2008/0314080 A1 Dec. 25, 2008

(51) Int. Cl.
*A44C 17/02* (2006.01)

(52) U.S. Cl. ..... 63/38; 63/4; 59/85

(58) Field of Classification Search ..... None
See application file for complete search history.

(56) References Cited

U.S. PATENT DOCUMENTS 2,007,445 A * 7/1935 Goldenberg ..... 59/80
2,580,589 A * 1/1952 Pfleger et al. ..... 59/85
4,473,365 A * 9/1984 Lapeyre ..... 474/212
4,815,270 A * 3/1989 Lapeyre ..... 59/84
4,840,044 A * 6/1989 Scholpp ..... 63/4
5,343,718 A * 9/1994 Poll ..... 63/26
5,636,506 A * 6/1997 Yngvesson ..... 59/80
6,158,575 A * 12/2000 Hitz ..... 198/803.14
6,293,128 B1 * 9/2001 Leufray-Simms ..... 63/23
7,353,665 B2 * 4/2008 Richardson ..... 63/38
7,444,836 B2 * 11/2008 Galligani ..... 63/38

* cited by examiner

*Primary Examiner*—Jack W. Lavinder

(57) ABSTRACT

An article of jewelry that includes removably interlocked links.

12 Claims, 13 Drawing Sheets

INTERLOCKING JEWELRY LINKS

BACKGROUND OF THE INVENTION

The present invention relates to interlockable links, and more particularly delinkable interlockable links which can receive precious stones.

Jewelry, such as a pendant or a bracelet, are often comprised of individual links that are permanently coupled to one another to form a plurality of links. In one design, for example, the links are attached to one another with a ring that is looped through opposing sides of two links at insert holes located on the links, and then the ring is soldered together to prevent the links from separating. In another design, a connecting member similar to a staple is employed whereby the connecting member is looped through opposing sides of two links at insert holes located on the links, and then the connecting member is bent down on itself to prevent the links from separating from each other.

SUMMARY OF THE INVENTION

The present invention provides an article of jewelry comprising links and a bail/post link that can be detachably connected to each other which is an improvement on the types of jewelry links that have been employed in the past. The invention relates to an article of interconnecting links which individually, or when interconnected with one another form a pendant, a bracelet, or the like, that can be hung from a chain when a bail link is connected to one of the links, used as an earring, when a post link is connected to one of the links, or used as a bracelet when enough links are connected to each other. Any number of links can easily and quickly be attached to one another by anyone without the need of instruments or adhesive devices. Additionally, the links, and the bail/post link can be separated from one another instantaneously.

Each link comprises a setting and a connecting member. The setting comprises a frame (which has a top side and an under side) which defines a jewel mount/cup shaped cradle for mounting a jewel, and two legs, extending from the top side of the frame. A plurality of prongs for holding a jewel in place may extend upward from the frame. The legs have a top side, a bottom side, a front side, and a back side. The two legs form a receiving compartment for receiving the connecting member of another link.

The connecting member, which comprises an extension arm and a locking head located at the end of the extension arm, extends outward from the under side of the frame. The locking head is wider in width than the extension arm and has a stepped portion to allow for a secure connection when the locking head is inserted into the receiving compartment of another link. The top side of the legs (the part that is closer to the under side of the frame) at the back side of the legs, are thinner than the lower end of the legs on the same side so that the portion of the receiving compartment that is formed on the back side of the legs is wider on the top side (forming shoulder portions) than on the bottom side. The wider width of the top side of the receiving compartment at the back side of the legs allows for the insertion of the locking head of the connecting member of another link. The front portion of the receiving compartment formed at the front side of the legs in the preferred embodiment is approximately the same width as the lower end of the receiving compartment formed at the bottom side of the back side of the legs. The width of the extension arm is less than the width of the receiving compartment at the narrowest part of the receiving compartment of another link, so that the extension arm can fit into the receiving compartment of another link. The width of the extension arm, however, is wide enough to prevent side to side movement of the extension arm when it is in the receiving compartment of another link. Additionally, the height of the legs of the link are such that they prevent side to side movement of the extension arm of another link that has been inserted into the receiving compartment of the link.

A bail link, which comprises a top portion, which may or may not have a frame which defines a jewel mount/cup shaped cradle, and a bottom portion which has two legs which extend from the top portion. A plurality of prongs for holding a jewel/precious stone may extend upward from the frame. The two legs form a receiving compartment for receiving the connecting member of one of the links. The top side of the legs (the part that is closer to the top portion of the bail link) at the back side of the legs, are thinner than the lower end of the legs on the same side so that the portion of the receiving compartment formed on the back side of the legs is wider on the top side (forming shoulder portions) than on the bottom side. The wider width of the top side of the receiving compartment formed at the back side of the legs allows for the insertion of the locking head of the connecting member of a link. The front portion of the receiving compartment formed at the front side of the legs in the preferred embodiment is approximately the same width as the lower end of the receiving compartment formed at the bottom side of the back side of the legs. Additionally, the under side of the top portion of the bail link has an indent for guiding the connecting member of a link through the receiving compartment of the bail link.

The bail link has a cutout on the side of each of the two legs for receiving a chain. The top of the cutout is larger in width than the remainder of the cutout so that a chain can extend from outside the bail link through both legs of the bail link.

A post link, which comprises a top portion, which may have a frame which defines a jewel mount/cup shaped cradle, and a bottom portion which has three legs, a first leg, a second leg, and a third leg, extend from the top portion. A plurality of prongs for holding a jewel/precious stone may extend upward from the frame. The three legs form a receiving compartment for receiving a connecting member of a link. Each of the legs has a foot portion which is relatively perpendicular to the portion of the leg that extends from the top portion of the post link. The first leg extends from the front side of the top portion of the post link, and has a post extending from its foot portion. The second and the third legs, which run parallel to each other, extend from the back side of the top portion of the post link. A space exists between the second and third legs.

The width of the first leg is greater than the combined width of the second and third legs, including the space. The foot portion of the first leg and the foot portions of the second and third legs face each other, but do not come in contact with each other, at the under side of the post link, forming an opening which is the upper portion of the receiving compartment for receiving a connecting member of a link. The space created between the second and third legs is the lower portion of the receiving compartment and has two equally spaced channels that run perpendicular to each other. The difference between the width of the upper portion and the lower portion of the receiving compartment creates a relatively T-shaped space. Additionally, a shoulder portions is formed between the ends of the foot portions of the first, second and third legs. The foot portion of the first leg has an additional foot portion extending relatively perpendicular from the foot portion inward towards the receiving compartment. The additional foot portion helps to guide the connecting member of a link downwards towards to lower portion of the receiving compartment.

The upper portion of the receiving compartment of the post link is wider than the lower portion of the receiving compartment of the post link. The wider width of the upper portion of the receiving compartment allows for the insertion of a locking head of a connecting member of a link. The smaller width of the lower portion of the receiving compartment prevents the connecting member of the link from sliding out of the post link once it has been rotated from the upper portion to the lower portion of the receiving compartment of the post link.

The links are attached to each other by inserting the locking head of the connecting member of a first link into the shoulder portions (formed by the top side of the back side of the legs of the second link) of the receiving compartment of a second link. The first link is then rotated from the back side of the legs of the second link to the front side of the legs of the second link. Since the front portion of the receiving compartment of the second link (as with all the links) is narrower than the locking head of the connecting member of the first link (as with all the links) the first link is secured to the second link, and the only way to separate the first link from the second link is to reverse the procedure just described. As such, in order to separate the first link from the second link, the first link must be rotated around from the front side of the legs of the second link to the back side of the legs of the second link till the locking head of the first link is at the shoulder portions of the receiving compartment of the second link. Once the locking head of the connecting member of the first link is aligned with the shoulder portions of the receiving compartment of the second link, the connecting member of the first link can be slide out from the shoulder portions of the receiving compartment of the second link.

Any number of links can be added to each other, or removed from each other in the same way, and the links in a group of links can be added to, or removed from a bail link in the same way i.e. by inserting the locking head of the connecting member of the link into the shoulder portions of the receiving compartment formed at the back side of the legs of the bail link, making sure that the locking head 46 comes in contact with the indent of the bail link, and then rotating according to the previously described procedure, and reversing the procedure to remove a link or a bail link from the group of links.

Additionally, any number of links can be added to each other, or removed from each other in the same way, and the links in a group of links can be added to, or removed from a post link by inserting the locking head of the connecting member of the link into the shoulder portions of the receiving compartment of the post link. This alignment allows for the post of the post link to be lying flat within the receiving compartment(s) of the attached link(s). Once the locking head of the connecting member of the link has been inserted into the shoulder portions of the receiving compartment of the post link, the links should be rotated at a downward right angle, at which point the top portion of the post link and the top portion(s) of the attached link(s) are facing in the same direction. The attached link(s) can be separated from the post link by reversing this procedure.

In a group of links, only one link can be added, or removed at a time. By example, in a group of three links, g11, g12, and g13, g11 is connected to g12, g12 is connected to g13. G13 cannot be removed from g12 until g12 has been removed from g11, because the legs of g11 will act as an obstacle to the locking head of the connecting member of g13 from coming in contact with the shoulder portions of the receiving compartment of g12. If the locking head of the connecting member of g13 cannot come in contact with the shoulder portions of the receiving compartment of g12, g13 cannot be separated from g12. The same concept applies to when a bail/post link has been attached to the group of links, namely, the bail/post link must be removed from the attached link before the remaining links in the group of links can be removed from each other.

When a chain is inserted through the bail link which has been attached to a link/group of links, or a post link attached to a link/group of links has been inserted through/clipped to an earlobe, the chain/earlobe blocks the shoulder portions of the receiving compartment of the bail/post link, and the locking head of the connecting member of the attached link cannot slide out of the shoulder portions of the bail/post link, and the link cannot be separated from the bail/post link. Since the link attached to the bail/post link cannot be separated from the bail/post link, the remaining links in the group of links cannot be separated from each other. As such, the chain/earlobe serves to lock the link/group of links to the bail/post link, and to each other. When a chain is not inserted in the bail link, or the post link is not inserted through/attached to an earlobe, the link/group of links attached to the bail/post link can be separated from each other one at a time.

One link can be attached to a bail/post link, or any number of link(s) can be attached to each other, and then to a bail/post link, making the pendant as long or as short as an individual desires. Furthermore, any number of links can be added together to form a bracelet. Additionally, link(s) can be added or removed at any point in time.

The link, bail link, or post link may have a frame which houses a jewel mount. The jewel mount in various embodiment can hold any kind of stone or jewel, real or fake, precious i.e. diamond, ruby, amethyst etc., or semi-precious, of any shape and size. The frame may also be any shape i.e. round, square, heart shaped, etc. Additionally, the link(s), and the bail/post link can be made of any one or more types of metal or alloy i.e. gold, platinum, etc., and can be one tone or multi-tonal.

The frame of the link, or the bail/post link, may contain a plurality of prongs for holding the stone/jewel in place, or in alternative embodiments the stone/jewel may be adhesively attached, or attached to the frame or the jewel mount by some other method.

Accordingly, the article allows for the detachable interconnecting of any number of links, and the attachment of a group of one or more links to a bail link, or a post link for use as a pendant. When a chain is inserted through the attached bail link, or the attached post link has been inserted through/clipped to an earlobe, the group of links attached to the bail/post link cannot be separated from each other, or from the bail/post link, thereby preventing the loss of link(s).

Accordingly, it is an object of the present invention to provide an article of jewelry comprising, a frame, and at least two legs extending from one side of the frame, the legs defining a receiving compartment to receiving a locking head of another link that includes a first channel adjacent the frame and a second channel adjacent the first channel having a longitudinal axis generally parallel to that of the first channel, the first channel including an open end, an obstruction at an end opposite the open end to obstruct the movement of the locking head, and two opposing, spaced sidewalls spaced by a first distance at the open end, and the second channel including a first open end and two opposing, spaced sidewalls spaced by a second distance that is less than the first distance. The second channel includes a second open end opposite the first open end thereof.

The article of jewelry may further comprises a locking head which is wider than the second distance, and less wide than the first distance and is adapted to be received in the open end of the first channel of a second link, while the partially closed end thereof and the second channel of the second link are narrow enough to intercept the locking head of the link.

The article of jewelry may also comprise an extension arm coupling the locking head to the frame, the extension arm being less wide than the first and the second distances.

In the article of jewelry a cross-sectional profile of the receiving compartment normal to the longitudinal axes of the channels may be generally T-shaped.

The article of jewelry may further comprise a setting for receiving a precious stone. The setting may contain a plurality of prongs extending from one side of the frame. The setting may comprises a generally cup-shaped cradle extending from one side of the frame.

The article of jewelry may form a pendent that can be hung from a chain, or used as an earring, or a bracelet. The article of jewelry may have an opening for receiving a chain, a post for inserting into an earlobe piercing, or a clip for clipping to an earlobe.

Another object of the present invention is to have an article of jewelry comprising a first link that includes a frame, and at least two legs extending from one side of the frame, the legs defining a receiving compartment to receiving a locking head of another link, the receiving compartment includes a first channel adjacent the frame and a second channel adjacent the first channel having a longitudinal axis generally parallel to that of the first channel, the first channel including an open end, an obstruction at an end opposite the open end, and two opposing, spaced sidewalls spaced by a first distance at the open end, and the second channel including an open end and two opposing, spaced sidewalls spaced by a second distance that is less than the first distance; and a second link having a locking head received in the first channel and obstructed from moving by the obstruction, whereby the first link and second link are removably linked to one another.

The first link may be a bail link that includes an opening for receiving a chain, or a post link that includes a post for inserting into an earlobe, or a clip for attaching to an earlobe. The second link may include a frame, and at least two legs extending from one side of the frame, the legs defining a receiving compartment to receiving a locking head of another link, the receiving compartment includes a first channel adjacent the frame and a second channel adjacent the first channel having a longitudinal axis generally parallel to that of the first channel, the first channel includes an open end, an obstruction at an end opposite the open end, and two opposing, spaced sidewalls spaced by a first distance at the open end, and the second channel including an open end and two opposing, spaced sidewalls spaced by a second distance that is less than the first distance. The first link may include a locking head coupled to a bail link or a post link. The bail link may include an opening for receiving a chain. The second link may further comprises a setting for receiving a precious stone.

Another object of the present invention is to provide an article of jewelry comprising a first link that includes a frame, and at least two legs extending from one side of the frame, the legs defining a receiving compartment to receiving a locking head of another link, the receiving compartment includes a first channel adjacent the frame and a second channel adjacent the first channel having a longitudinal axis generally parallel to that of the first channel, the first channel including an open end, a partially closed end opposite the open end, and two opposing, spaced sidewalls spaced by a first distance at the open end, and a second distance at the partially closed end that is less than the first distance, and the second channel including an open end and two opposing, spaced sidewalls spaced by a third distance that is less than the first distance; a second link that includes a locking head, a frame and at least two legs extending from one side of the frame, the legs defining a receiving compartment to receiving a locking head of another link, the receiving compartment includes a first channel adjacent the frame and a second channel adjacent the first channel having a longitudinal axis generally parallel to that of the first channel, the first channel including an open end, a partially closed end opposite the open end, and two opposing, spaced sidewalls spaced by a first distance at the open end, and a second distance at the partially closed end that is less than the first distance, and the second channel including an open end and two opposing, spaced sidewalls spaced by a third distance that is less than the first distance, the locking head of the second link being received in an open end of the first channel of the first link and abutting the sidewalls of the partially closed end thereof; and a third link including a locking head received in the open end of the first channel of the second link and abutting the sidewalls of the partially closed end thereof.

Another object of the present invention is to have an article of jewelry comprising a link that includes a frame with a jewelry piece, and at least three legs extending from one side of the frame, the legs defining a receiving compartment to receive a locking head of another link, the receiving compartment including an upper portion and a lower portion, the upper portion having a wider width than the lower portion, the lower portion containing two equally spaced channels running perpendicular to each other.

The article of jewelry may be a post link which has a post for inserting into an earlobe piercing. Additionally, the article of jewelry may further comprising a second link capable of being received in the receiving compartment of the link, and a third link capable of being received in a receiving compartment of the second link.

The article of jewelry may further comprise a second link capable of being received in the receiving compartment of the link, the second link comprising a frame with a jewelry piece; and at least two legs extending from one side of the frame, the legs defining a receiving compartment to receive a locking head of another link, the receiving compartment including a first channel adjacent the frame and a second channel adjacent the first channel having a longitudinal axis generally parallel to that of the first channel, the first channel including an open end, an obstruction at an end opposite said open end to obstruct the movement of the locking head, and two opposing, spaced sidewalls spaced by a first distance at the open end, and the second channel including a first open end and two opposing, spaced sidewalls spaced by a second distance that is less than the first distance; and an extension arm coupling a locking head to the frame, the extension arm being less wide than the second distance.

These, and various other and further features and advantages of the invention will become apparent from the following detailed description, taken in conjunction with the accompanying drawings, which illustrate by way of example the principle of the invention.

DETAILED DESCRIPTION OF EMBODIMENTS OF THE INVENTION

Figure 1A:
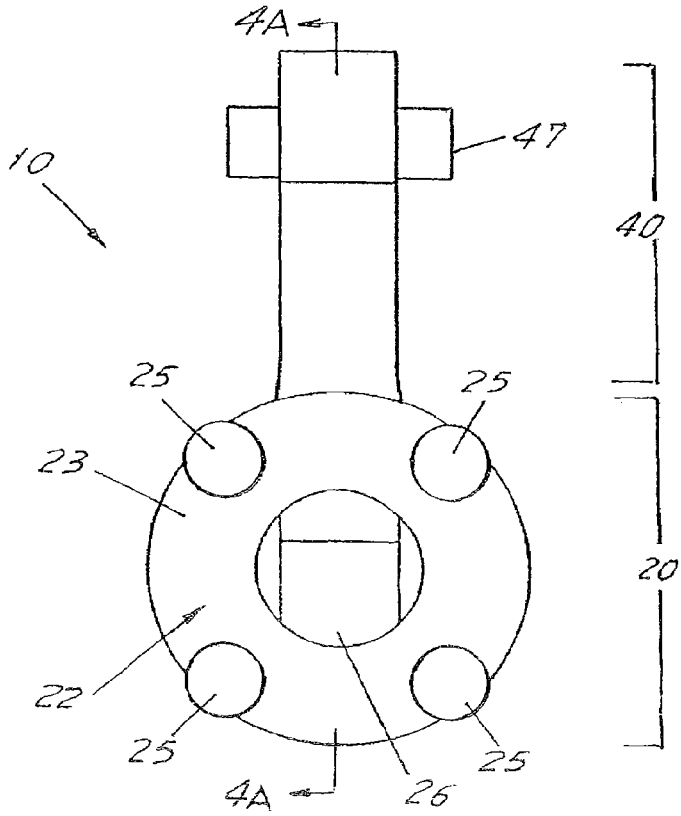
FIG. 1A shows a top plan view of a first embodiment of a link according to the present invention.
Figure 1B:
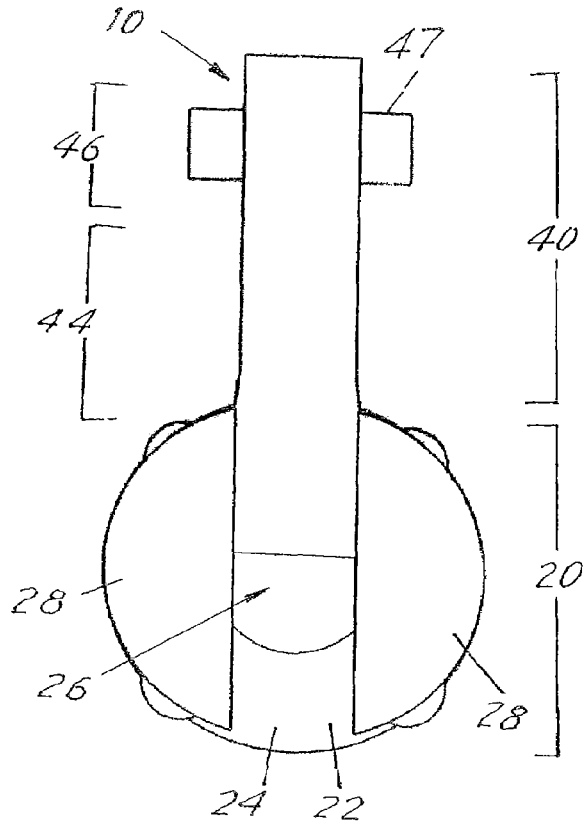
FIG. 1B shows a bottom plan view of the link shown in FIG. 1.

An article of jewelry according to the present invention includes individual links which can be removably coupled to one another to form a pendant.

Referring to FIGS. 1-5, a link 10 according to a first embodiment of the present invention includes a setting 20 and a connecting member 40. Note that link 10 is preferably made from a precious metal such as gold, platinum or the like. The setting 20 comprises a circular frame 22, a jewel mount/cup shaped cradle 26 formed in the frame 22, and two legs 28. The frame 22 comprises a top side 23 and an under side 24. In the first embodiment, a plurality of prongs 25 extend up from top side 23 of frame 22 to secure a precious stone such as a diamond.

The legs 28, which extend from the under side 24 of the frame 22, consist of a top side 28*a*, a bottom side 28*b*, a front side 33, and a back side 29, and are arranged to define a receiving compartment 27. The receiving compartment 27 includes shoulder portions 30 and a lower end 31 formed at the back side 29 of the legs 28. The top side 28*a* of the back side 29 of the legs 28 are thinner in width than the bottom side 28*b* of the back side 29 of the legs 28. The thinner width at the top side 28*a* of the back side 29 of the legs 28 result in shoulder portions 30 of the receiving compartment 27 which is larger in width than the lower end 31 of the receiving compartment 27. The front portion 34 of the receiving compartment 27 at the front side 33 of the legs 28 in the preferred embodiment is approximately the same width as the lower end 31 of the receiving compartment 27 at the bottom side 28*b* of the back side 29 of the legs 28.

In the preferred embodiment of the present invention, the receiving compartment 27 so defined includes a first channel 100 adjacent the frame 22 and a second channel 105 adjacent the first channel 100 having a longitudinal axis generally parallel to that of the first channel 100. According to an aspect of the present invention, the first channel 100 includes an open end 101 and two opposing, spaced sidewalls 102. According to the preferred embodiment, the spacing between the sidewalls of the first channel 100 narrows to define a partially closed end 103 opposite said open end 101 thereof, whereby the spacing between the sidewalls 102 at the partially closed end 103 of the first channel 100 is narrower than the spacing between the sidewalls at the open end 101 thereof. The second channel 105, which is open to and in communication with the first channel 100 also includes opposing sidewalls 106 and two open ends 107. Preferably the distance between the sidewalls of the second channel 105 is less than the spacing between the sidewalls 102 of the first channel 100 at the open end 101 thereof. Note that the difference in spacing between the sidewalls 102 of the first channel 100 and the second channel 105 results in the realization of shoulder portions or ledges 30. In addition, the narrowing of the spacing between the opposing sidewalls 102 of the first channel 100 results in abutment walls 110.

Figure 2:
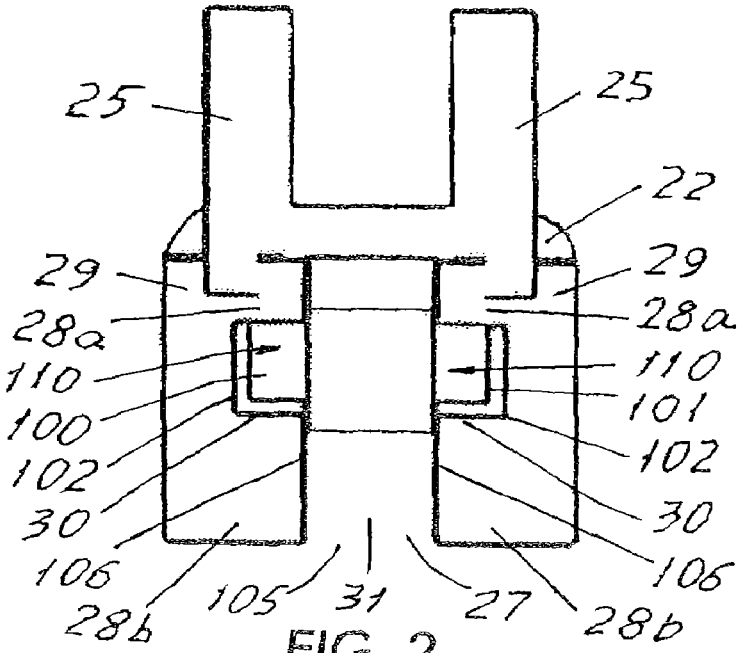
FIG. 2 shows a back plan view of the embodiment shown in FIG. 1.
Figure 3:
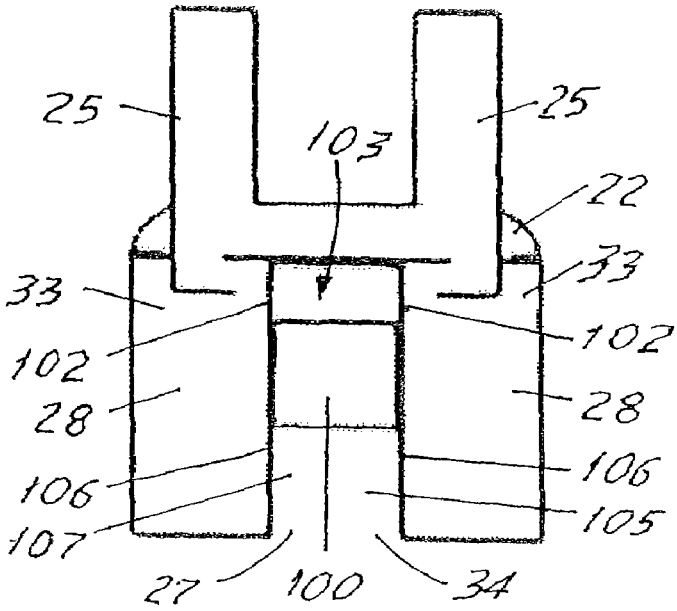
FIG. 3 shows a front plan view of the embodiment shown in FIG. 1.
Figure 4A:
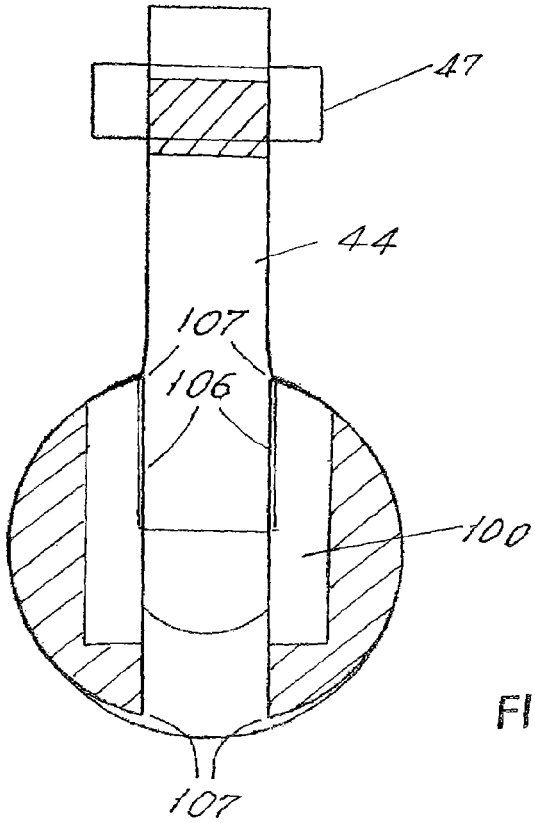
FIG. 4A shows a cross sectional view along line 4A-4A of FIG. 1 A viewed in the direction of the arrows.
Figure 5:
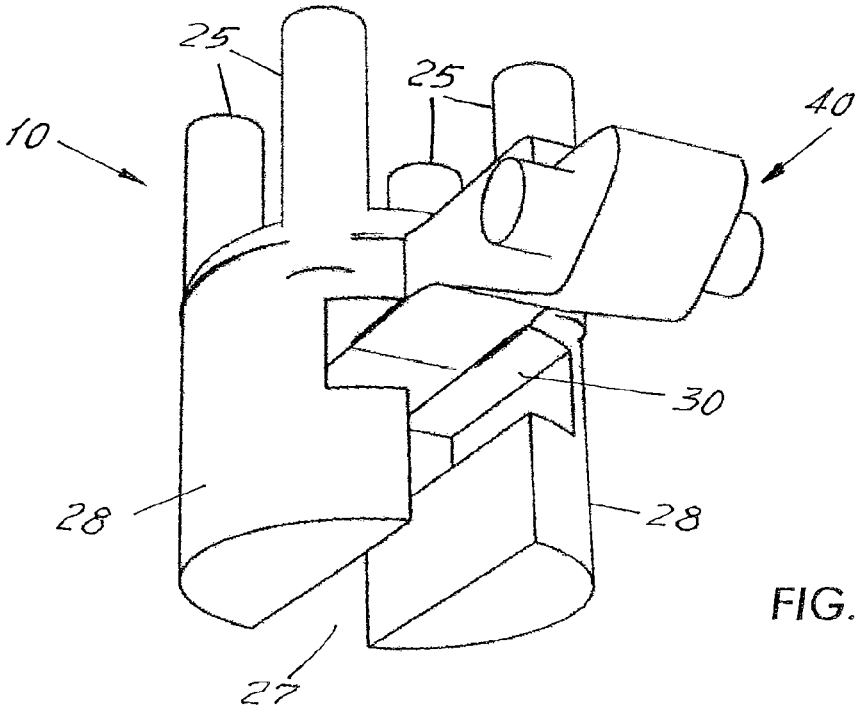
FIG. 5 shows a bottom perspective view of the embodiment shown in FIG. 1.
Figure 6:
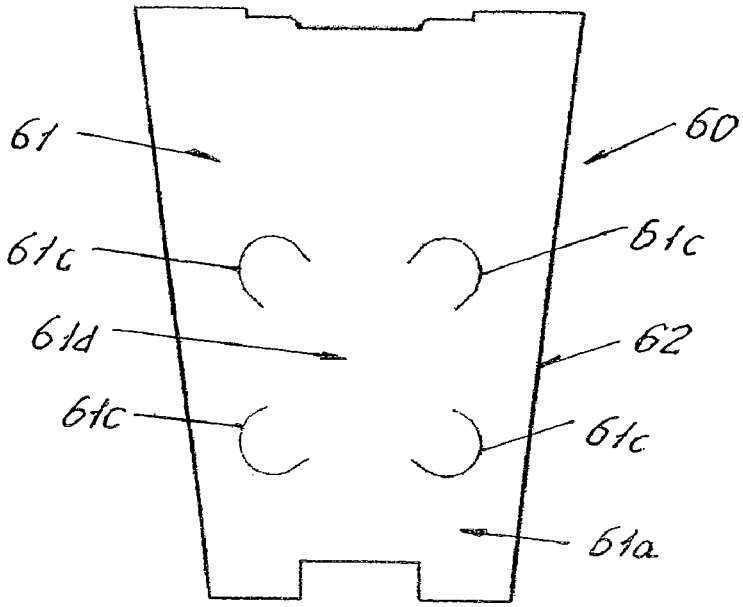
FIG. 6 shows a top plan view of a bail link according to the present invention.
Figure 7:
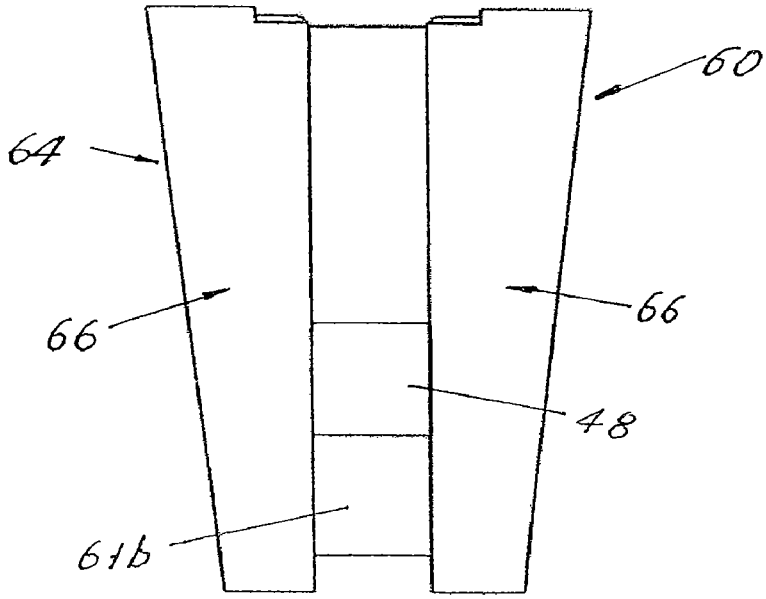
FIG. 7 shows a bottom plan view of the bail link shown in FIG. 6.

In the preferred embodiment, the cross-sectional profile of the receiving compartment 27 taken normal to the longitudinal axes of the first 100 and the second channels 105 is T-shaped as illustrated in FIG. 2. It should be understood, however, a link 10 according to the present invention need not be limited to such a cross-sectional profile.

The connecting member 40 of the link 10 extends from the under side 24 of the frame 22 and includes an extension arm 44 and a locking head 46. The locking head 46, which has a stepped portion 47, is larger in width than the extension arm 44.

FIGS. 6-12 show different views of a preferred embodiment of a bail link 60 of the present invention which comprises a top portion 62, and a bottom portion 64. The top portion 62 in the present embodiment depicts a frame 61 which houses a jewel mount/cupped shaped cradle 61*d* for receiving a precious stone, such as a diamond. The frame 61 has a top side 61*a* and a bottom side 61*b*. The bottom side 61*b* of the frame has an indent 48. In the preferred embodiment, a plurality of prongs 61*c* extend from the top side 61*a* of the frame 61 to secure a precious stone such as a diamond. In alternative embodiments, however, prongs 61*c* may not be present. The bottom portion 64 of the bail link 60 comprises two legs 66 similar to the legs 28 of the link 10.

Each leg 66, extending from the bottom side 61*b* of the frame 61, comprises a top side 66*a*, a bottom side 66*b*, a front side 74, a back side 68, and two general sides 76, and are arranged to realize a receiving compartment 67. The top side 66*a* of the back side 68 of the legs 66 are thinner in width than the bottom side 66*b* of the back side 68 of the legs 66. The thinner width of the top side 66*a* of the back side 68 of the legs 66 result in shoulder portions 70. The front portion 75 of the receiving compartment 67 formed at the front side 74 of the legs 66 in the preferred embodiment is approximately the same width as the lower end 72 of the receiving compartment 67 formed at the bottom side 66*b* of the back side 68 of the legs 66.

The two general sides 76 of the legs 66 contain a cutout 78 which has a top 80 and a remainder 82. The top 80 of the cutout 78 is larger in width than the remainder 82 so that a chain can fit through the cutout 78 at the top 80 and remain in place.

In the preferred embodiment of the bail link 60, the receiving compartment 67 so defined includes a first channel 400 adjacent the frame 61 and a second channel 405 adjacent the first channel 400 having a longitudinal axis generally parallel to that of the first channel 400. According to an aspect of the present invention the first channel 400 includes an open end 401 and two opposing, spaced sidewalls 402. According to the preferred embodiment, the spacing between the sidewalls of the first channel 400 narrows to define a partially closed end 403 opposite said open end 401 thereof, whereby the spacing between the sidewalls 402 at the partially closed end 403 of the first channel 400 is narrower than the spacing between the sidewalls 402 at the open end 401 thereof.

The second channel 405, which is open to and in communication with the first channel 400 also includes opposing sidewalls 406 and two open ends 407. Preferably the distance between the sidewalls of the second channel 405, i.e. the spacing there between, is less than the spacing between the sidewalls 402 of the first channel 400 at the open end 401 thereof. Note that the difference in spacing between the sidewalls 402 of the first channel 400 and the second channel 405 results in the realization of shoulder portions or ledges 70. In addition, the narrowing of the spacing between the opposing sidewalls 402 of the first channel 400 results in abutment walls 410.

Figure 8:
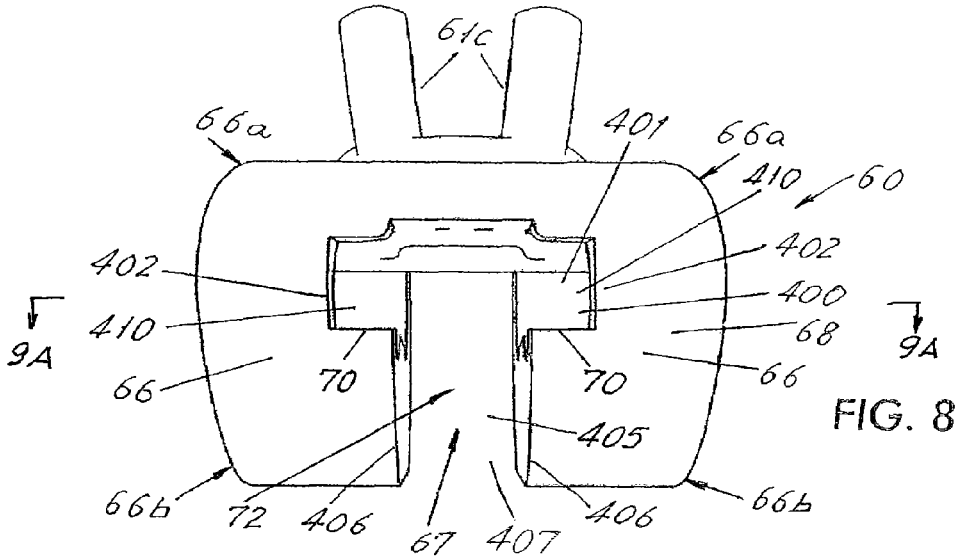
FIG. 8 shows a back plan view of the bail link shown in FIG. 6.
Figure 9:
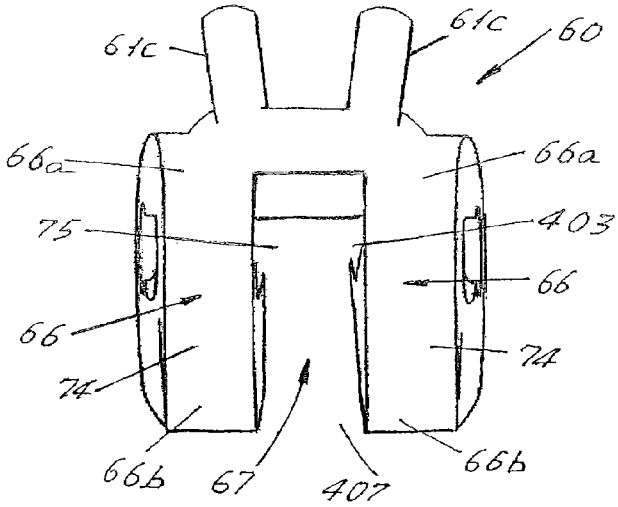
FIG. 9 shows a front plan view of the bail link shown in FIG. 6.
Figure 9A:
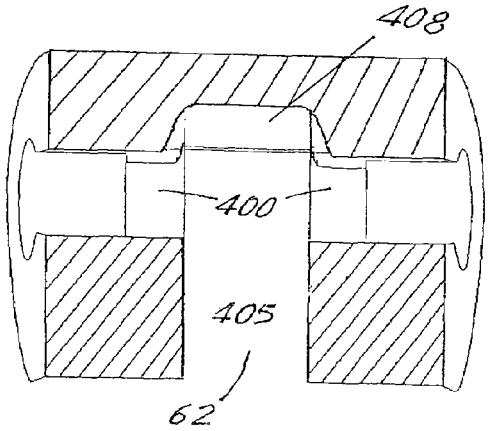
FIG. 9A shows a cross sectional along line 9A of FIG. 8 of the bail link shown in FIG. 8.
Figure 10:
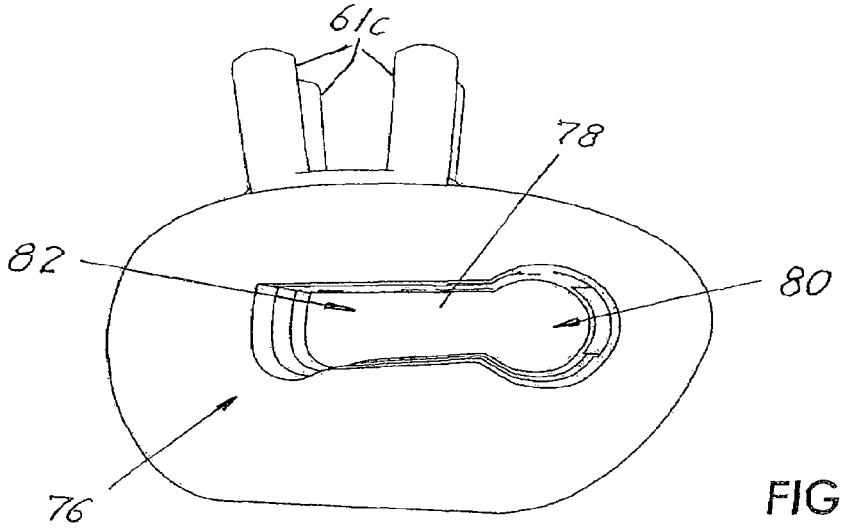
FIG. 10 shows a side view of the bail link shown in FIG. 6.
Figure 11:
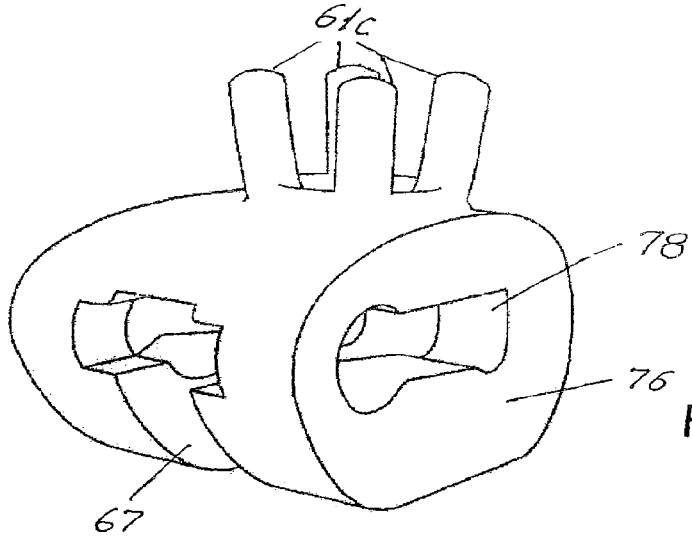
FIG. 11 shows a back perspective view of the bail link shown in FIG. 6.
Figure 12:
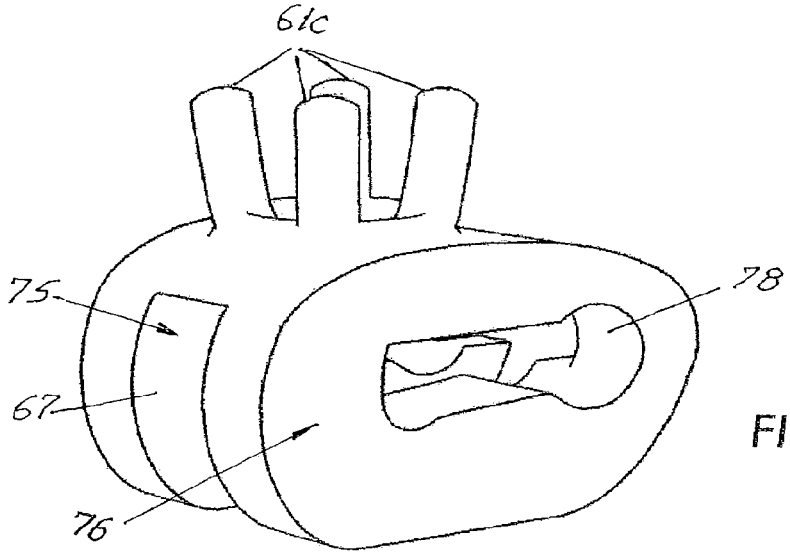
FIG. 12 shows a side perspective view of the bail link shown in FIG. 6.

In the preferred embodiment, the cross-sectional profile of the receiving compartment 67 taken normal to the longitudinal axes of the first 400 and the second channels 405 is T-shaped as illustrated by FIG. 8. It should be understood, however, a bail link 60 according to the present invention need not be limited to such a cross-sectional profile.

Figure 13:
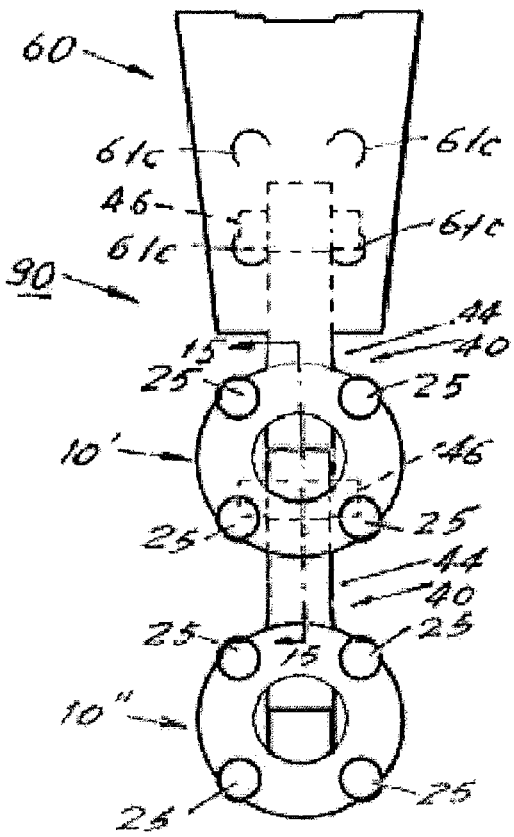
FIG. 13 shows a top plan view of a group of links coupled to each other and further coupled to a bail link.
Figure 14:
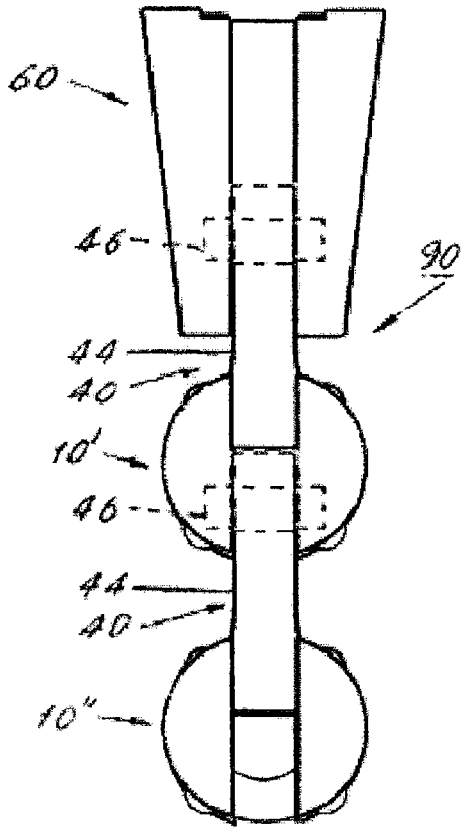
FIG. 14 shows a bottom plan view of the embodiment shown in FIG. 13.
Figure 15:
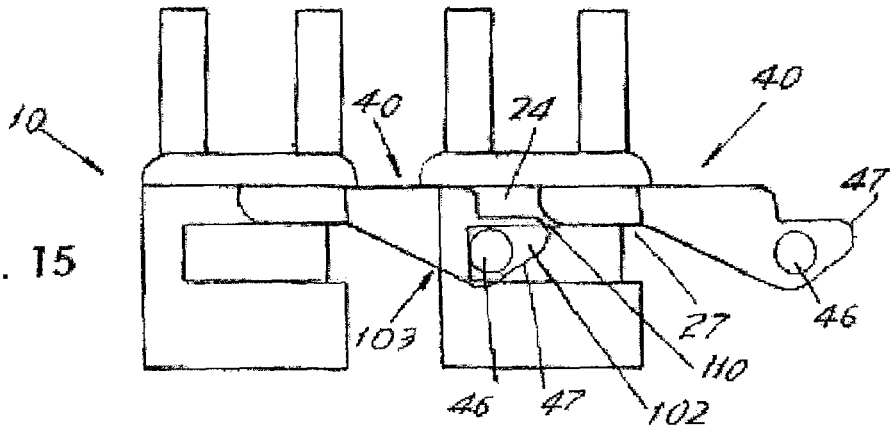
FIG. 15 shows a cross sectional view cut along line 15-15 of FIG. 13 viewed in the direction of the arrows.

FIGS. 13 and 14 show a top and bottom plan view of a group of links coupled to each other and further coupled to a bail link. FIG. 15 shows a cross sectional view cut along line 15-15 of FIG. 13 depicting the locking head 46 of the connecting member 40 of a link 10 abutting against the abutment walls 110, and the two opposing, spaced sidewalls 102 at the partially closed end 103 of the first channel 100 of the second link 10. When the locking head 46 of the link 10 has been received in the receiving compartment 27 of the second link 10, the locking head 46 of the first link 10 would be obstructed from movement by abutment walls 110 sidewalls 102, the under side of frame 24, and shoulder portions 30 because the locking head 46 is wider than the distance between sidewalls 106 and the gap between abutment walls 110. Note, however, locking head 46 could be moved along the longitudinal axis of the first channel 100 because the first channel 100 is wider than locking head 46, but abutment walls 110 act as an obstruction against the movement of locking head 46 further along the first channel 100.

Figure 16A:
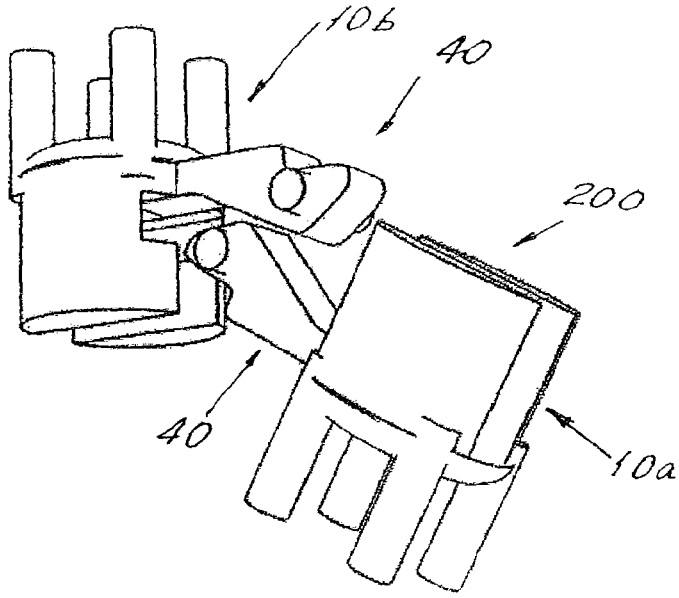
FIGS. 16A-16C shows the procedure for interlocking two links according to the present invention.
Figure 16B:
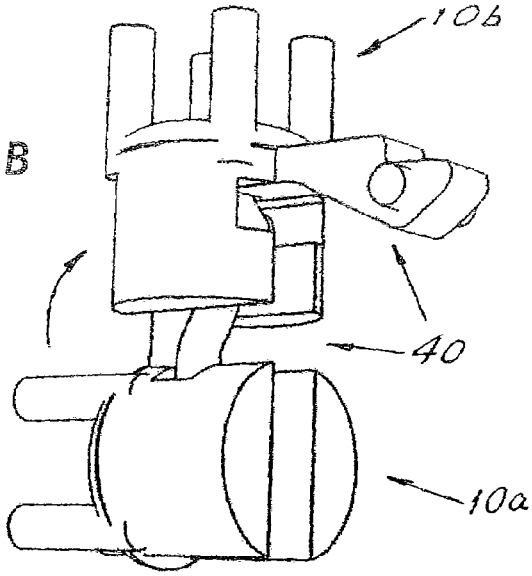
Figure 16C:
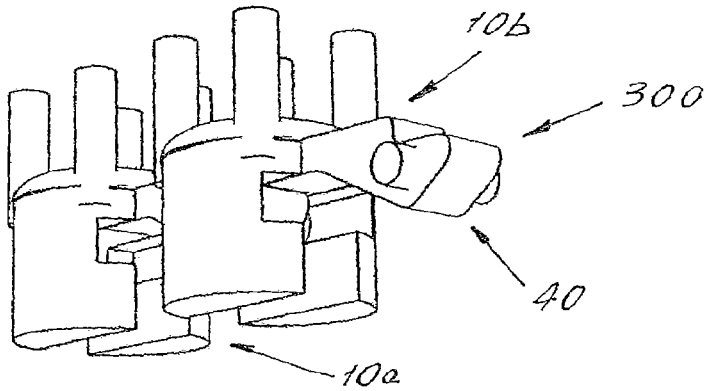

FIGS. 16A-16C show the method for coupling two links 10 together according to an aspect of the present invention. Two links 10 are coupled to one another by inserting the locking head 46 of the connecting member 40 of the first link 10*a* into the open end 101 of the first channel 100 of a second link 10*b* and then rotating the first link 10*a* about an axis through locking head 46 thereof transverse to the longitudinal axis of the receiving first channel from a first position 200 to a second position 300. In first position 200, the two links 10*a* and 10*b* are aligned with each other such that the frame 22 of each of the two links 10*a* and 10*b* are facing in opposite directions. In a second position 300, the two links 10*a* and 10*b* are aligned with each other such that the frame 22 of each of the two links 10*a* and 10*b* are both facing in the same direction. As the first link 10*a* is moved in relation to the second link 10*b* from a first position 200 to a second position 300, the extension arm 44 of the first link 10*a* passes through the second channel 105 of the receiving compartment 27 of the second link 10*b*.

Accordingly, two links 10 are coupled to each other by inserting the locking head 46 of the connecting member 40 of a first link 10*a* into the open end 101 of the first channel 100 of the receiving compartment 27 of a second link 10*b*. The first link 10*a* is then rotated from the open end 101 of the first channel 100 of the second link 10b to the partially closed end 103 of the first channel 100 of the receiving compartment 27 of the second link 10*b*. When the locking head 46 of the first link 10*a* has been engaged with the partially closed end 103 of the receiving compartment 27 of the second link 10*b*, the locking head 46 of the first link 10*a* may be restricted from motion by abutting against three walls of the receiving compartment 27 of the second link 10*b*, namely, the abutment wall 110, and the two opposing, spaces sidewalls 102 at the partially closed end 103 of the first channel 100 of the second link 10*b*.

Any number of links 10 can be attached in the same way as previously described. Additionally, the only way to separate two links 10 from each other is to reverse the steps shown in FIGS. 16A-16C i.e. to rotate the first link 10*a* from position 300 to position 200.

The procedure shown in FIGS. 16A-16C can be repeated to add as many links 10 to a group of links as one desires or the reverse procedure can be employed to remove a link 10 from a group of links as desired.

According to an aspect of the present invention, a bail link 60 or a post link 92 can be coupled to a terminal link 10 in a group of links, and prevent the disassembly thereof.

Figure 17A:
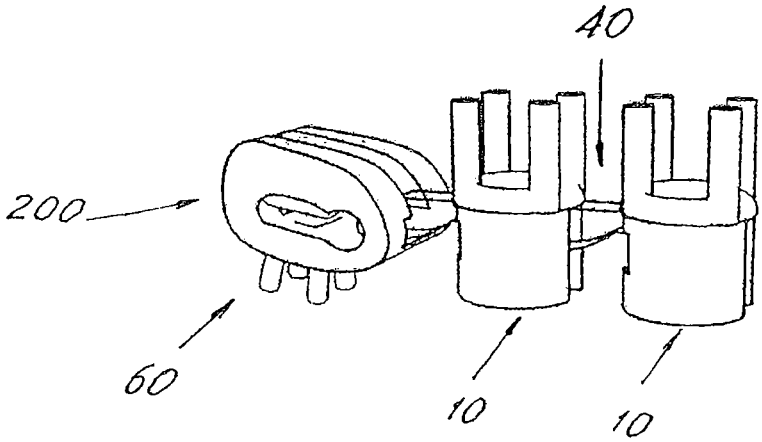
FIGS. 17A-17C shows the procedure for interlocking a group of links to a bail link according to the present invention.
Figure 17B:
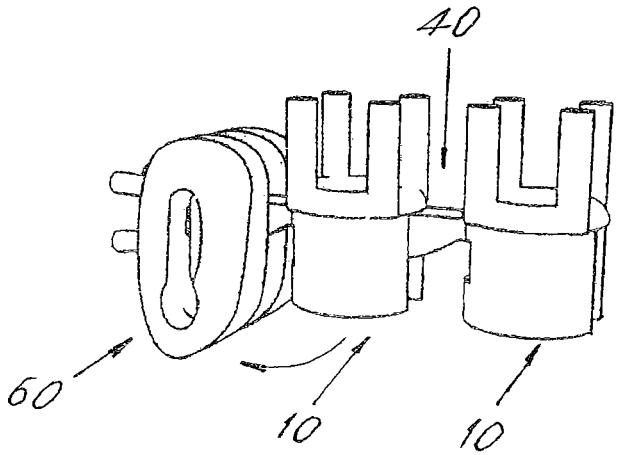
Figure 17C:
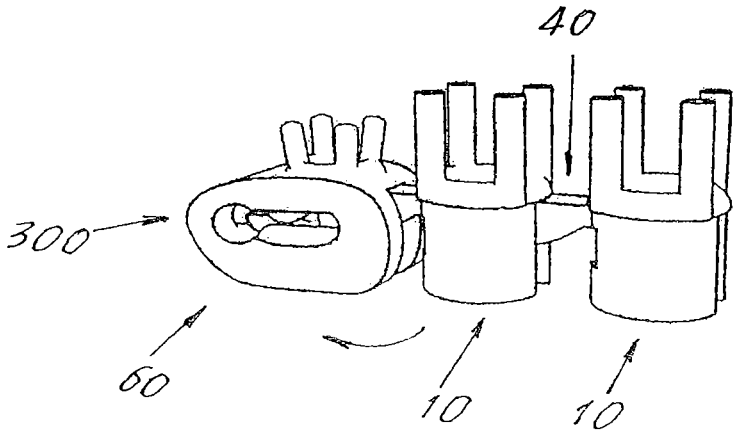
Figure 17D:
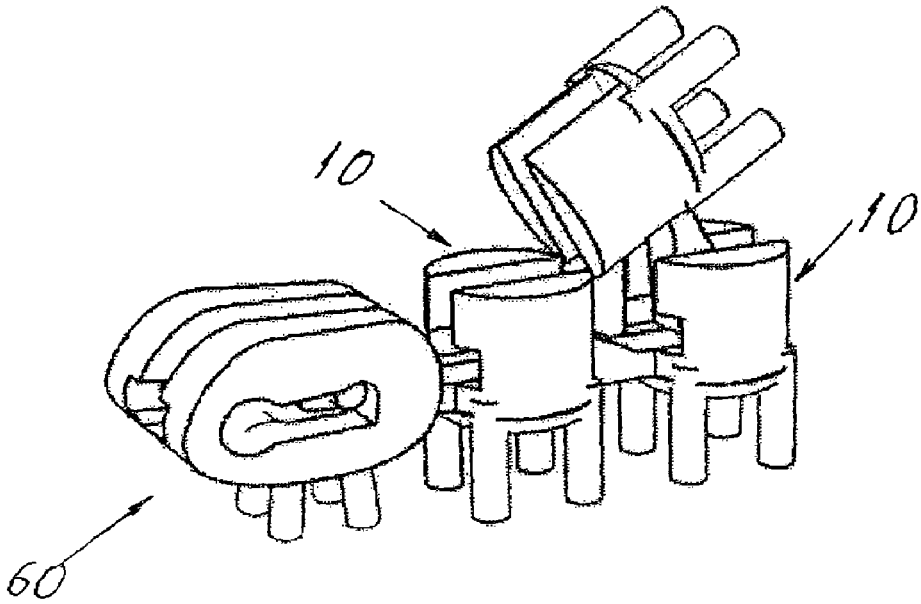
FIGS. 17D-17E shows how links coupled to a bail link cannot be removed from each other until the bail link has been removed.
Figure 17E:
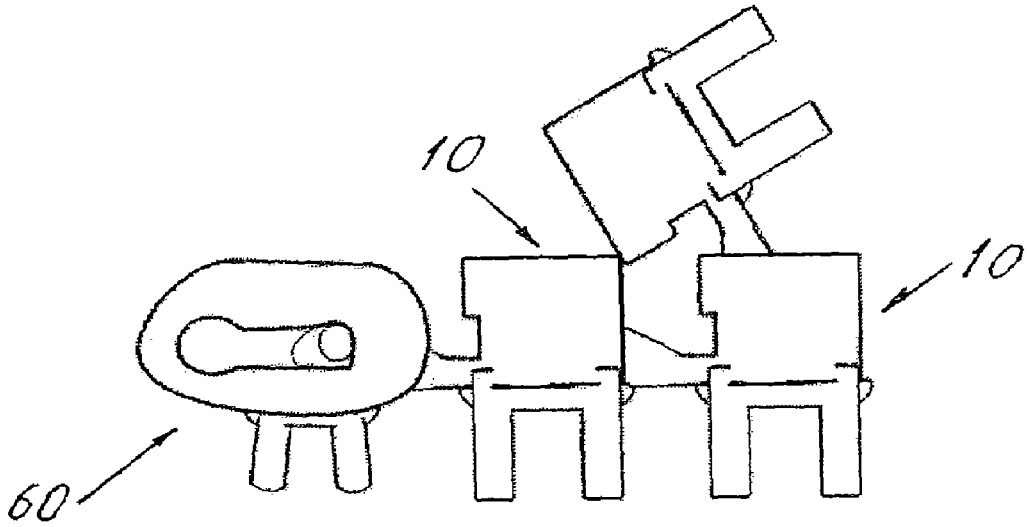

FIGS. 17A-17C show the method of coupling a group of links 10 to a bail link 60. FIGS. 17D-17E shows how links coupled to a bail link cannot be removed from each other until the bail link has been removed. A link 10 is attached to a bail link 60 by inserting the locking head 46 of the connecting member 40 of a link 10 into the open end 401 of the first channel 400 of a bail link 60, making sure that the locking head 46 comes in contact with the indent 48 of the bail link 60, and then rotating the bail link 60 from a first position 200 to a second position 300. In first position 200, the link 10 and the bail link 60 are aligned with each other such that the frame 22 of link 10 and the top portion 62 of the bail link are facing in opposite directions. In a second position 300, the link 10 and the bail link 60 are aligned with each other such that the frame 22 of the link 10 and the top portion of the bail link 60 are both facing in the same direction. As the bail link 60 is moved in relation to the link 10 from a first position 200 to a second position 300, the extension arm 44 of the link 10 passes through the second channel 405 of the receiving compartment 67 of the bail link 60.

Accordingly, a link 10 and a bail link 60 are coupled to each other by inserting the locking head 46 of the connecting member 40 of a link 10 into the open end 401 of the first channel 400 of the receiving compartment 67 of the bail link 60. The bail link 60 is then rotated such that the locking head 46 of the link 10 passes from the open end 401 of the first channel 400 of the bail link 60 to the partially closed end 403 of the first channel 400 of the receiving compartment 67 of the bail link 60. When the locking head 46 of the link 10 has been engaged with the partially closed end 403 of the receiving compartment 67 of the bail link 60, the locking head 46 of the link 10 may be restricted from motion by abutting against three walls of the receiving compartment 67 of the bail link 60, namely, the abutment walls 410, and the two opposing, spaces sidewalls 402 at the partially closed end 403 of the first channel 400 of the bail link 60.

Figure 18:
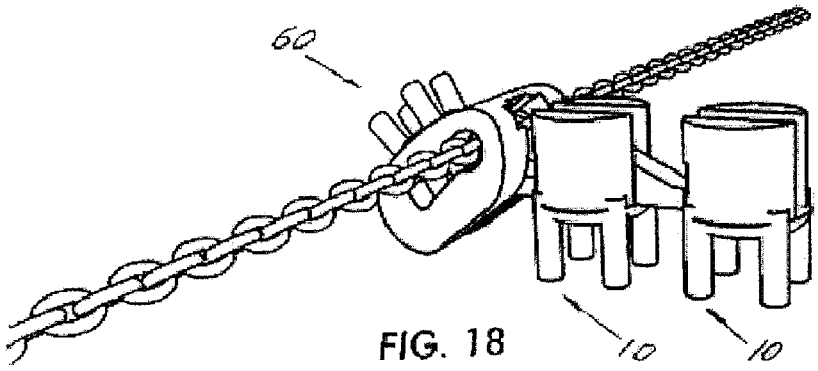
FIGS. 18-19 show a chain inserted through the bail link.
Figure 19:
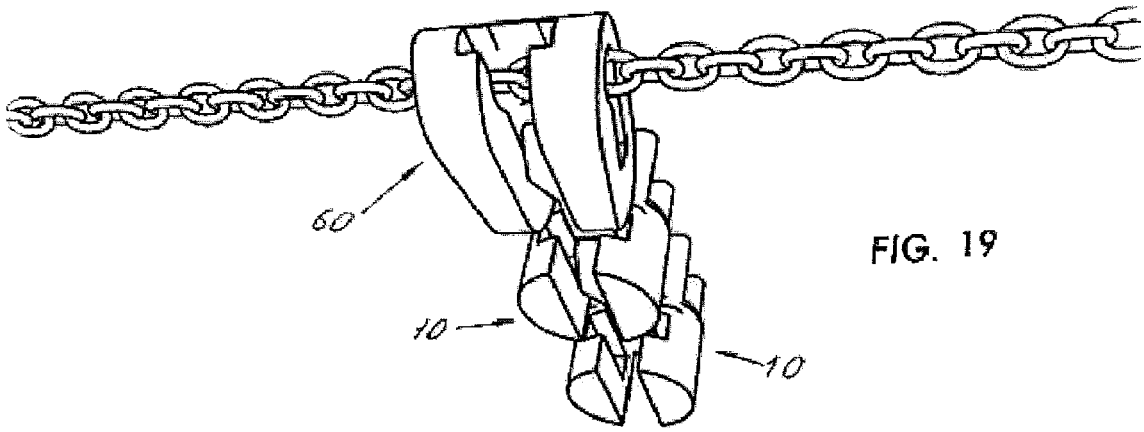

FIGS. 18 and 19 shows a chain inserted through the bail link of a pendant. When a bail link 60 has been attached to either one or more links 10 a pendant 90 is formed. When a chain is then inserted through the bail link 60 of the pendant 90 the link(s) 10 attached to the bail link 60 cannot be separated from one another because the open end 101 of the first channel 400 of the receiving compartment 67 of the bail link 60 is blocked by the chain. Since the first channel 400 of the bail link 60 is blocked by the chain the locking head 46 of the connecting member 40 of the link 10 that is attached to the bail link 60 cannot be slid out of the receiving compartment 67 formed at the back side 68 of the legs 66 of the bail link 60. Since the link 10 attached to the bail link 60 cannot be separated from the bail link 60, the link(s) 10 that are further connected to the link 10 attached to the bail link 60 cannot be separated from each other because the locking head 46 of the connecting member 40 of each of the links 10 cannot escape the receiving compartment in which it is residing.

Figure 20:
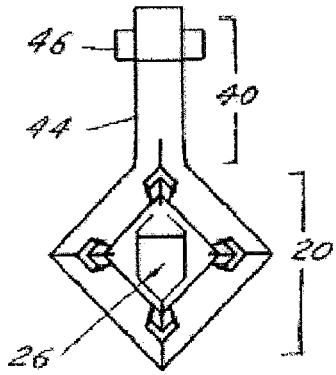
FIG. 20 shows a top plan view of a second embodiment of a link according to the present invention.

FIG. 20 shows a top plan view of a second embodiment of a link 10 which has the same features as the link 10 depicted in FIGS. 1-5 except that the general shape of the frame thereof is diamond shaped, rather than round/oval.

Figure 21:
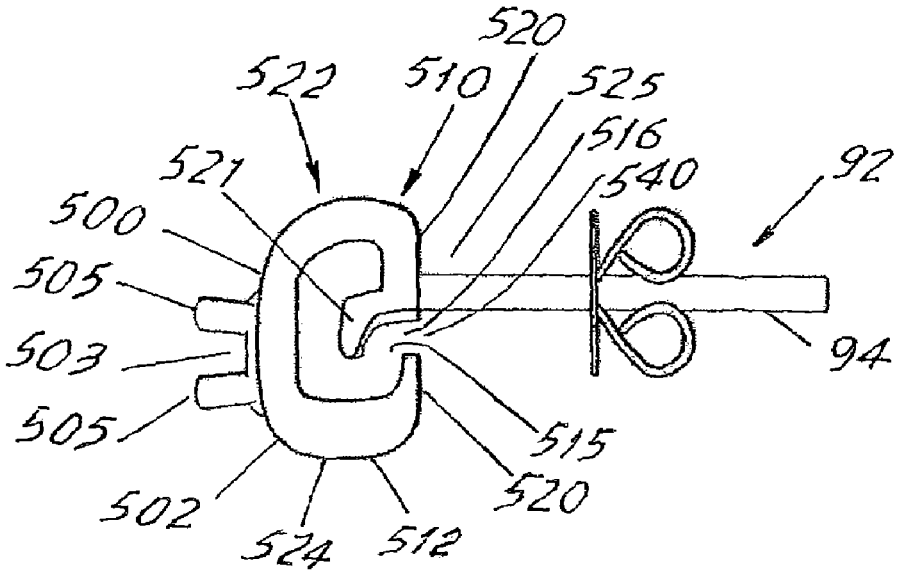
FIG. 21 shows a side view of a first embodiment of a post link according to the present invention.
Figure 22:
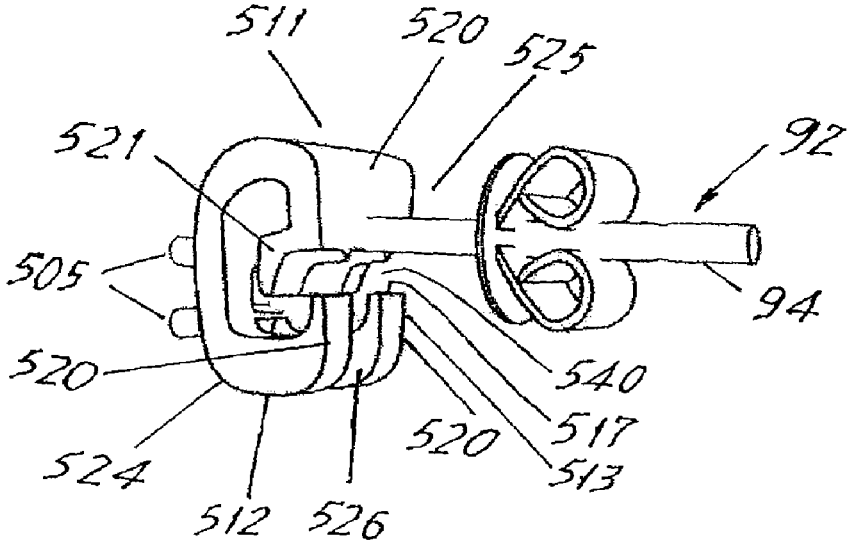
FIG. 22 shows a back perspective view of a post link shown in FIG. 21.

FIGS. 21-22 shows a first embodiment of a post link 92. A post link 92, which comprises a top portion 500, which may or may not have a frame 502 which defines a jewel mount/cup shaped cradle 503, and a bottom portion 510 which has three legs, a first leg 511, a second leg 512, and a third leg 513, which extend from the top portion 500. A plurality of prongs 505 for holding a jewel/precious stone may extend upward from the frame 502. The three legs 511/512/513 form a receiving compartment 515 for receiving a connecting member 40 of a link 10. Each of the legs 511/512/513 has a foot portion 520 which is relatively perpendicular to the portion of the leg 511/512/513 that extends from the top portion 500 of the post link 92. The first leg 511 extends from the front side 522 of the top portion 500 of the post link 92, and has a post 94 extending from its foot portion 520. The second 512 and the third legs 513, which run parallel to each other, extend from the back side 524 of the top portion 500 of the post link 92. A space 526 exists between the second 512 and third legs 513. The foot portion 520 of the first leg 511 and the foot portions 520 of the second 512 and third legs 513 face each other, but do not come in contact with each other, at the under side 525 of the post link 92, forming an opening 540 which is the upper portion 516 of the receiving compartment 515 for receiving a connecting member 40 of a link 10. The space 526 created between the second 512 and third legs 513 is the lower portion 526 of the receiving compartment 515 and has two equally spaced channels that run perpendicular to each other. The difference between the upper portion 540 and the lower portion 526 of the receiving compartment 515 creates a relatively T-shaped space. Additionally, shoulder portions 517 are formed between the ends of the foot portions 520 of the first 511, second 512 and third legs 513. The foot portion 520 of the first leg 511 has an additional foot portion 521 extending relatively perpendicular from the foot portion 520 inward towards the receiving compartment 515. The additional foot portion 521 helps to guide the connecting member 40 of a link 10 towards to lower portion 526 of the receiving compartment 515.

Figure 23A:
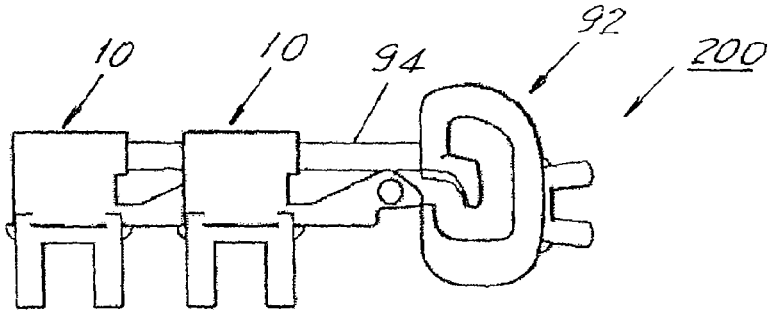
FIGS. 23A-23C shows the procedure for interlocking a group of links to a post link according to the present invention.
Figure 23B:
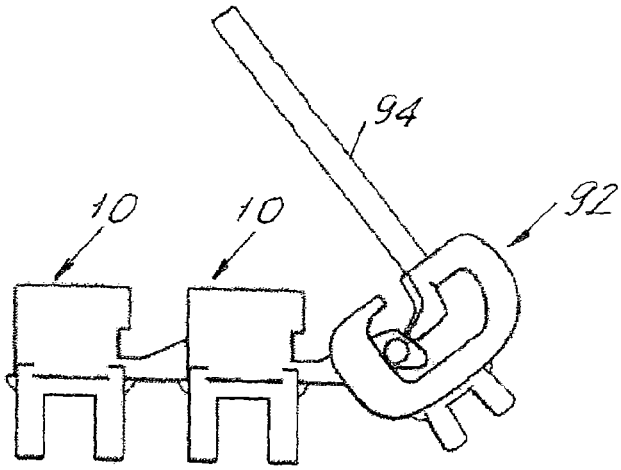
Figure 23C:
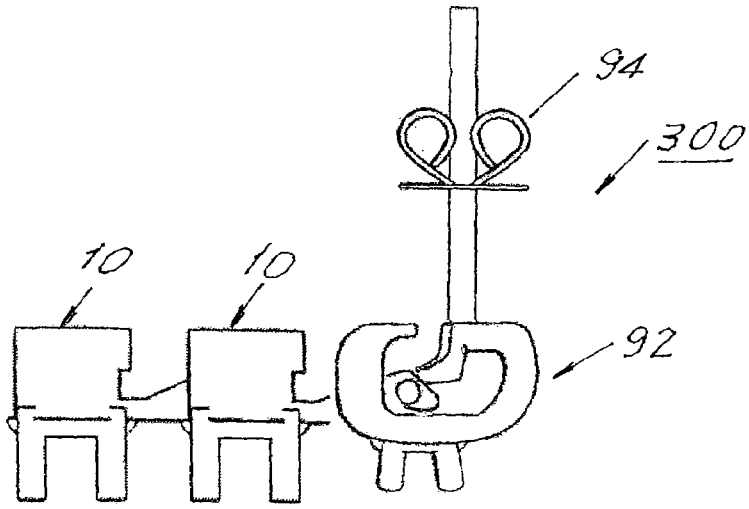

FIGS. 23A-23C shows the procedure for interlocking a group of links to a post link according to the present invention. Any number of links 10 in a group of links 10 can be added to, or removed from a post link 92 by inserting the locking head 46 of the connecting member 40 of the link 10 into the shoulder portions 517 of the receiving compartment 515 of the post link 92 and rotating the link(s) 10 from a first position 200 to a second position 300. In the first position 200, the locking head 46 of the connecting member 40 of the link 10 is inserted into the shoulder portions 517 of the receiving compartment 515 of the post link 92. This alignment allows for the post 94 to be lying flat within the receiving compartment(s) 27 of the attached link(s) 10. Once the locking head 46 of the connecting member 40 of the link 10 has been inserted into the shoulder portions 517 of the receiving compartment 515 of the post link 92, the links 10 are rotated at a downward right angle (second position 300) so that the top portion 500/frame 502 of the post link 92 and of the frame(s) 22 of the attached link(s) 10 are facing in the same direction. The attached link(s) 10 can be separated from the post link 92 by reversing the procedure for attaching a link(s) 10 to a post link 92.

It will be understood that the embodiments described herein are merely exemplary and that a person skilled in the art may make many variations and modifications without departing from the spirit and scope of the invention. All such modifications and variations are intended to be included within the scope of the invention as defined herein.

What is claimed is:

1. An article of jewelry system having a plurality of interchangeable interlocking links comprising:

a plurality of detachable links, each of the links having a top side and a bottom side with at least two depending leg members, wherein two adjacent and connected channels are formed between the leg members, wherein a first of the two adjacent channels has a longitudinal axis generally parallel to the longitudinal axis of a second of the two adjacent channels, said first channel including an open end and an obstruction at an end opposite said open end to obstruct the movement of a locking head, said second channel including two open ends;

a first link of the plurality of detachable links further includes a device for attaching the first link to a wearer;

the additional links of the plurality of detachable links further include an extension arm with a locking head located on the end of the extension arm and said first of the two adjacent channels of the additional links having a longitudinal axis generally parallel to the longitudinal axis of said second of the two adjacent channels of the additional links and said extension arm, wherein the article of jewelry is formed by connecting one additional link to the first link by inserting the extension arm with the locking head into the channels of the first link or by connecting multiple additional links to one another by inserting the extension arms with the locking head into the channels of the adjacent links and then attaching an end most link extension arm with the locking head into the channels of the first link.

2. The article of claim 1, further comprising a locking head which is less wide than said first channel and wider than said second channel.

3. The article of claim 2, wherein said extension arm being less wide than said first and second channels.

4. The article of claim 1, wherein said second channel includes a second open end opposite said first open end thereof.

5. The article of claim 1, further comprising a jewel mount.

6. The article of claim 5, wherein said jewel mount comprises a plurality of prongs, or alternative embodiment for holding a stone/jewel in place.

7. The article of claim 1, wherein said device for attaching the first link to a wearer includes an opening for receiving a chain.

8. The article of claim 7, wherein said opening, when a chain is inserted through the opening of said first link which has been attached to an additional link or multiple additional links, the chain blocks the said open end of said first channel of the first link, and said locking head of said additional link cannot slide out.

9. The article of claim 8, wherein the chain serves as a lock.

10. The article of claim 1, wherein said device for attaching the first link to a wearer further comprising a post for attaching to an earlobe, said additional links are prevented from disengagement from the first link while the article of jewelry is attached to the earlobe.

11. The article of claim 1, wherein the leg members of one link cooperate with an obstruction on the extension arm of an adjacent link to prevent the additional links attached to said first link from being detached from the article of jewelry until the first link is removed from the attached additional links.

12. The article of claim 1, wherein each link further comprises a top portion that has a jewelry piece or holds precious/semi-precious stones.

* * * * *